United States Patent [19]

Feaster

[11] 4,191,867

[45] Mar. 4, 1980

[54] MINIATURE SWITCHES

[75] Inventor: Donavon L. Feaster, New Bedford, Mass.

[73] Assignee: Sonitronics, Inc., Flushing, N.Y.

[21] Appl. No.: 939,634

[22] Filed: Aug. 7, 1978

Related U.S. Application Data

[62] Division of Ser. No. 774,318, Mar. 4, 1977, Pat. No. 4,117,280.

[51] Int. Cl.[2] ..... H01H 15/02

[52] U.S. Cl. ..... 200/16 R; 200/153 LA; 200/291; 200/303

[58] Field of Search ..... 200/11 EA, 11 R, 11 K, 200/16 R, 16 C, 16 D, 291, 153 L, 153 LA, 303

[56] References Cited

U.S. PATENT DOCUMENTS

| | | | |
|---|---|---|---|
| 3,917,921 | 11/1975 | Jakubauskas | 200/16 R X |
| 3,944,760 | 3/1976 | Zdanys et al. | 200/16 R X |
| 3,975,601 | 8/1976 | Whelan | 200/11 R |
| 4,012,608 | 3/1977 | Lockard | 200/16 R X |

*Primary Examiner*—James R. Scott
*Attorney, Agent, or Firm*—Charles E. Temko

[57] ABSTRACT

A slide-actuated switch of precision type including first and second housing elements defining a hollow casing, the first housing element having an elongated slotted opening therethrough with a manually engageable sliding member projecting through the opening. The sliding member includes a recess in an inwardly facing surface. A resilient cam means is positioned within the recess, and includes a wedge-shaped projection. The second housing element has an inwardly-extending septum thereon defining a plurality of detents selectively engaging said projection. A pair of contacts is disposed in overlapping relation within the housing, one of the contacts having cam follower means thereon slideably engaging the projection on the cam means.

1 Claim, 16 Drawing Figures

MINIATURE SWITCHES

This is a Division of application Ser. No. 774,318, field Mar. 4, 1977 now U.S. Pat. No. 4,117,280.

BACKGROUND OF THE INVENTION

This invention relates generally to the field of electronic circuitry, and more particularly to improvements in so-called DIP switches. Switches of this type are widely used for manually connecting or disconnecting individual circuits on a given circuit board, as for example, to permit the performance of individual test operations on said circuits independently of other circuits on the board. Because of space limitations, such switches are usually fabricated in groups within a common housing and, depending upon type of actuation, they are provided with individual toggles, or sliding actuators, or are operated from a common longitudinally arranged operating shaft having cams thereon which is incrementally rotated between positions to serially open or close individual switch contacts. Devices of this general type are, accordingly, well known in the art, and the invention resides in specific refinements of construction which provide improved ease of manufacture, assembly, and improved reliability and longevity in use.

SUMMARY OF THE INVENTION

Briefly stated, the invention contemplates the provision of a variety of improved DIP switches, in which certain prior art disadvantages have been eliminated or substantially ameliorated.

In one embodiment, of a type in which a plurality of individual switches are mounted in a common housing element to be actuated by a single shaft extending longitudinally within said housing, the individual operating cams are radially aligned by bearing journals integrally formed on each side thereof, and fitted into correspondingly sized bores molded into each half of a pair of housing members. The actuating shaft itself is formed as a single piece of pinion stock which mates with a corresponding opening in each cam. The pinion spacing allows for a detenting mechanism without the addition of a separate star wheel or similar structure. The pinion shaft also permits ease of assembly of an end control cap. Where such cap is not required, a simple drilling operation permits a screwdriver adjustment without incorporating a slotting operation on the shaft. The shaft includes an end portion of reduced diameter serving as a stop for axial motion thereof. Detents are made of individual springs engaging the interstices between adjacent pinion teeth on an end of the pinion shaft.

In another embodiment, a slide actuator mounts a pressure button which serves a double purpose in that it actuates the contacts as well as forms part of the detenting structure to hold the contacts in desired position.

Another embodiment employs a rocker-type actuator, the rocker having cam means thereon directly contacting one of two contact elements to urge the same to closed condition with respect to the other, and to permit it to resiliently ride in contact with the cam when in open condition, so as to provide damping means for absorbing vibration.

A modification of one embodiment employs a pair of mating double gears to enable an elongated shaft operating plural cams to be adjusted from a side rather than an end location.

Still another embodiment employs a rotationally mounted toggle having a simplified detent means formed from a single length of resilient material.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figures 1, 2, 3, 4:
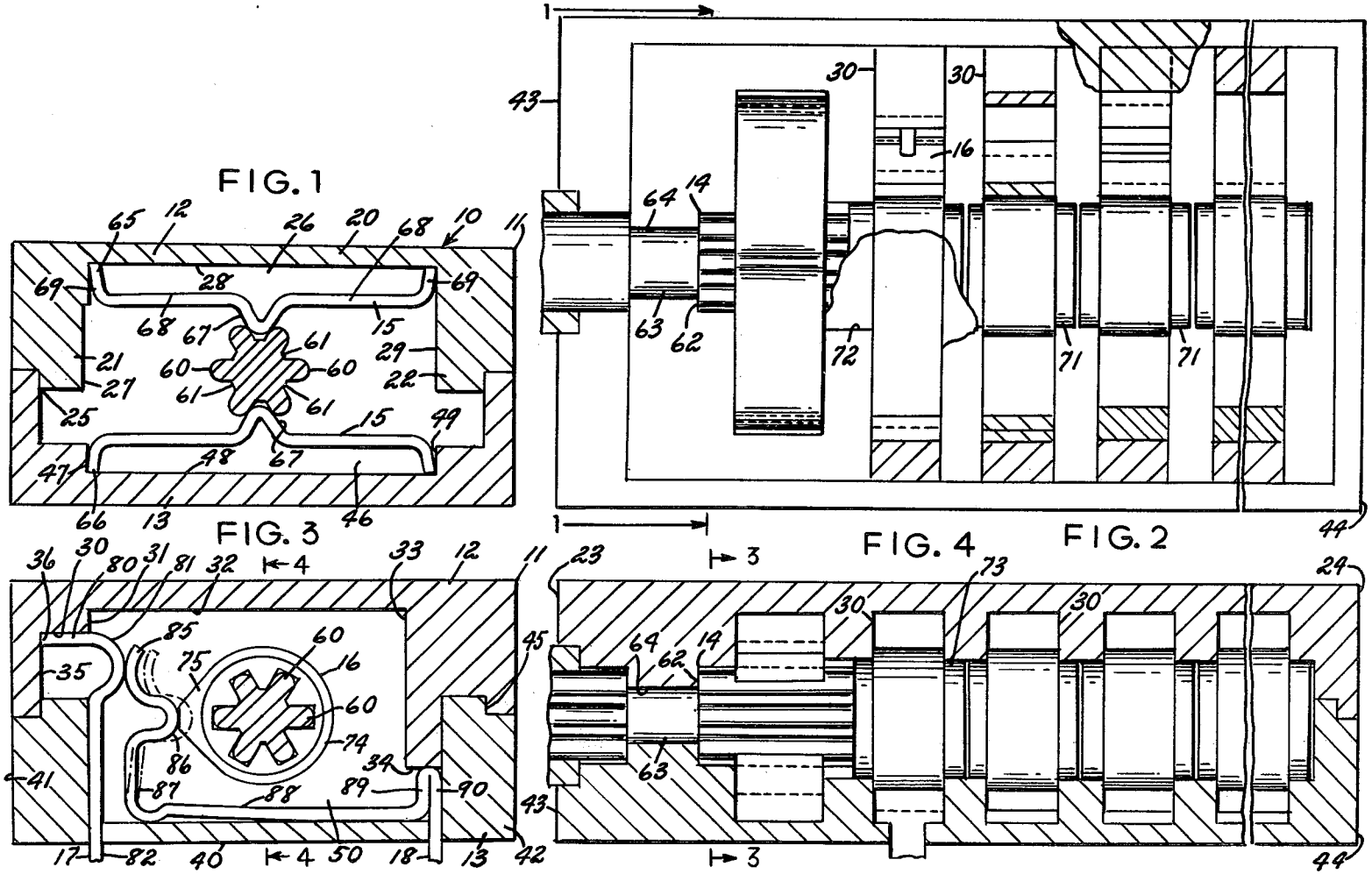
FIG. 1 is a transverse sectional view of a first embodiment of the invention, as seen from the plane 1—1 in FIG. 2.
FIG. 2 is a fragmentary plan view of the first embodiment, with an upper housing element removed, and partially broken away to show detail.
FIG. 3 is a transverse sectional view as seen from the plane 3—3 in FIG. 4.
FIG. 4 is a central fragmentary vertical sectional view as seen from the plane 4—4 in FIG. 3.

In accordance with the first embodiment of the invention, the device, generally indicated by reference character 10, comprises broadly: a casing element 11 formed by first and second housings 12 and 13, respectively, a main shaft element 14, detent means 15, a plurality of camming means 16, and first and second contact elements 17 and 18, respectively.

The first or upper housing 12 is formed of molded synthetic resinous material, and includes an upper wall 20, side walls 21 and 22, and end walls 23 and 24. Continuous keying means 25 in the form of a rabbet or equivalent mates the housing 12 with the housing 13. A recess 26 defined by surfaces 27, 28 and 29 accommodates the detent means 15. A plurality of individual switch retaining recesses 30 (FIGS. 2 and 4) are substantially similar, each bounded by walls 31, 32, 33, 34 and 35. A surface 36 provides a seat for one of the contact elements.

The housing 13 is, similarly, of molded material, and includes a lower wall 40, side walls 41 and 42 and end walls 43 and 44. Corresponding keying means 45 (FIG. 3) engages with the means 25 on the first housing 12. A detent retaining recess 46 is formed by surfaces 47, 48 and 49 (FIG. 1). Switch recesses 50 correspond to the recesses 30, and are formed by surfaces 51, 52 and 53. A pair of openings 54 and 55 for each switch recess 50 provide egress for the contact elements 17 and 18, in well known manner.

The main shaft element 14 is formed as a pinion of known type. It includes a plurality of teeth 60 defining interstices 61 therebetween. An indented area 62 which may be machined to close tolerances (FIG. 4) forms a single bearing surface 63 mating with corresponding bearing surfaces 64 of the casing element 11. As will become more clearly apparent, since the individual camming means 16 are not supported by the shaft element 14, but merely driven by them, a single bearing surface is sufficient, the same serving as stop means preventing axial movement of the shaft element.

The detent means 15 is best seen in FIG. 1, and includes an upper spring 65, and a lower spring 66 of substantially identical configuration. Each includes a raised projection 67 supported by a pair of flexible portions 68 communicating with a pair of terminal portions 69 which resiliently retain the springs within the respective detent recesses 26 and 46. The flexible portions 68 flex radially outwardly with respect to the principal axis of the shaft element 14 when the shaft element is rotated, and re-enter an appropriate interstice on each side of the shaft when the desired position of adjustment is obtained.

The camming means 16 are preferably formed as individual synthetic resinous moldings, each including bearing extensions 71 clamped between corresponding bearing surfaces 72 and 73 in the housings 12 and 13, respectively. A central flange portion 74 includes one or more cam lobes 75, depending upon the number of positions of the shaft element 14 in which it is desired to have a particular switch in closed position.

The first contact element 17 is formed of conductive material, such as copper or alloys thereof, and includes a rectilinear portion 80 (FIG. 3), an arcuate contact portion 81 and an elongated rectilinear portion 82 which extends outwardly of the casing element 11. The corresponding second contact element 18 includes an arcuate terminal portion 85, a cam contacting portion 86, a flexing portion 87, a transverse portion 88, a flat loop portion 89 and an elongated rectilinear portion 90, which like the portion 82 extends outwardly of the casing element for interconnection with a printed circuit board or similar circuitry (not shown).

From a consideration of FIGS. 1 and 3, it will be apparent that the main shaft element 14 may be detented in increments of 60°, because of the presence of six teeth comprising the pinion. It will be understood that other numbers of teeth may be employed where a greater or lesser number of detenting positions are required. The camming means 16, is configured internally to correspond to the cross section of the shaft element, and thus a single lobe cam of the type shown in FIG. 3 may be positioned relative to the other cam lobes in the switch at adjusted positions varying from each other in multiples of 60°. Where desired, camming means (not shown) having multiple or continuous cam lobes extending through 120° or more may be used where the particular switch involved is to remain closed throughout several adjustment increments. Thus, at the time of assembly, the necessary selection of parts can be varied using stock hardware.

In the modified form of the first embodiment, generally indicated by reference character 92 (FIGS. 5 and 6) the casing element 93 is modified to accommodate a laterally oriented beveled gear 94 having an integrally molded short shaft, the gear 94 meshing with a second beveled gear 95 engaging a terminal portion of the main shaft element 96. The detent means 97 is substantially identical to that in the principal form. The beveled gear 94 is provided with screwdriver slot means 98 whereby adjustment can be performed through a side wall of the casing element where access at the ends thereof is not possible.

Turning now to the second embodiment of the invention, generally indicated by reference character 100 (FIGS. 7, 8 and 9), this embodiment provides a so-called "rocker" type actuation particularly suitable where a top action is desired and where the overall height of the device is to be maintained at a minimum. It includes a casing element 101 including an upper housing 102 and a lower housing 103. Mounted within the casing element are a plurality of first contacts 104, a plurality or second contacts 105, each pair of contacts 104–105 being closed by a rocker element 106 urged to either of two positions by over center springs 107 and 108.

The upper housing 102 includes an upper wall 110 defining a transversely extending opening 111 for positioning of the toggle element. The wall 110 also includes a plurality of arcuate recesses 112 forming bearing surfaces for the toggle element as well as suitable keying 113.

The lower housing 103 includes a lower wall 120, side walls 121 and 122, and end walls, one of which is indicated by reference character 123. Extending upwardly from the inner surface of the lower wall 120 are a plurality of trunnion members 124 which cooperate with the arcuate recesses 112.

The first contacts 104 each include a rectilinear projecting portion 130, a bent portion 131 and an elongated contact portion 132. The second contacts 105 include a rectilinear projecting portion 134, a bent portion 135, a resilient portion 136, a cam-contacting portion 137 and a terminal portion 138 including a contact area 139.

The rocker elements 106 are integrally molded, to include a main body portion 141, bearing portions 142 and cam portions 143. Positioned within a plane passing through the axis of rotation 145 are a pair of slotted recesses 144. The springs 107–108 are engaged in one of the recesses. They are preferably formed from single lengths of formed metallic materials, and include a compressible loop portion 146, a fixed terminal 147 engaging a recess in the casing element, and a movable terminal 148. From a consideration of FIG. 8 it will be apparent that the movable terminal of each spring will be depressed above or below a plane passing through the axis of rotation, depending on the position of the rocker element. As with the other embodiments, the cam portion 143 provides a damping effect on the resilient portion 136 of the contact 105 when the switch is in opened condition.

Figure 10:
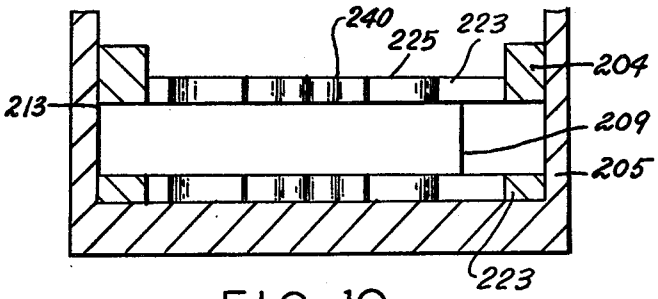
FIG. 10 is a fragmentary horizontal sectional view of a housing comprising part of a third embodiment of the invention as seen from the plane 10—10 in FIG. 11.

Turning now to the third embodiment of the invention, (FIGS. 10 to 12, inclusive), this form is particularly suited for installations where only limited access to the upper surface of the casing element is available. It includes a slider type actuating member which may be operated by a hand-held instrument in those installations where there is not sufficient room to permit the finger of a user to directly contact actuating means.

Figure 12:
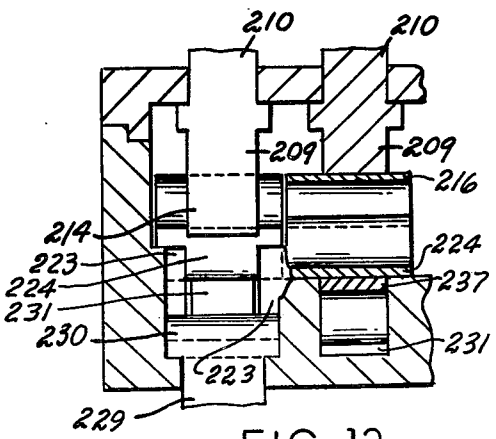
FIG. 12 is a fragmentary sectional view of the third embodiment as seen from the plane 12—12 in FIG. 11.
Figure 11:
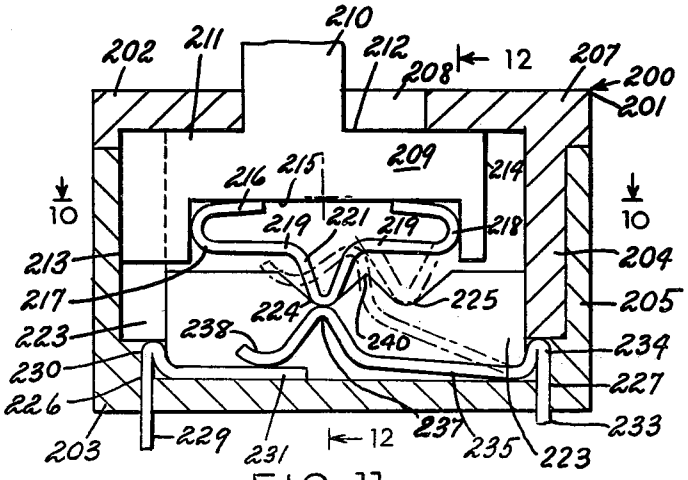
FIG. 11 is a vertical sectional view of the third embodiment.

Referring to FIG. 11, the embodiment, 200, includes a casing element 201 formed by an upper member 202 and a lower member 203. These are interconnected by mating means 204 on member 202 and 205 on member 203 (FIG. 12).

The upper member 202 includes an upper wall 207 defining a slotted opening 208 in which a slider element 209 is positioned. The element 209 includes a projection 210 extending through the opening 208 and a main body member 211 including a horizontal wall 212, and first and second vertical walls 213–214, respectively. An inwardly disposed surface defines a rectangular recess 215 accommodating a resilient cam member 216 including first and second loop portions 217–218 interconnected by an elongated portion 219 a part of which is deformed to form a wedge-shaped detent engaging projection 221.

The lower member 203 includes a plurality of inwardly extending septums 223 each forming first and second notches 224 and 225 selectively engaging the projection 221 to detent the sliding member 210 in either of two positions.

The first and second contact elements 226–227 are generally similar to those in the other embodiments, the first contact element 226 including an elongated portion 229, a bent portion 230 and a planar portion 231. The element 227 includes an elongated portion 233, a bent portion 234, a resilient portion 235, a cam follower portion 237 and a terminal portion 238.

As will be observed from FIG. 11, the member 216 serves as both a part of the detenting means and as a cam to close the switch, and is of an effective width to overlie both the cam follower portion 237 and the septum 223. Although the projection 221 parts contact with the cam follower portion 237 as it passes over the high point 240 separating the detent notches 224–225, it again contacts the portion 237 when engaging the notch 225 to provide the same damping effect as in the other embodiments.

Figure 13:
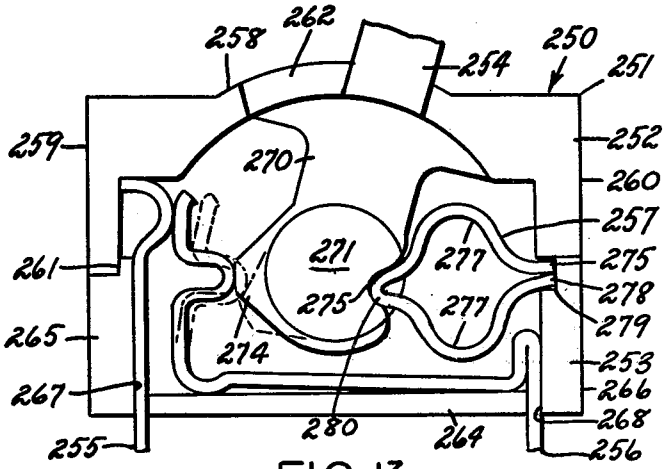
FIG. 13 is a fragmentary transverse sectional view of a fourth embodiment of the invention.

Turning now to the fourth embodiment of the invention, illustrated in FIG. 13 in the drawing, this construction features toggle actuation, particularly desirable where access to the upper surface of the switch is relatively uninhibited.

The fourth embodiment, generally indicated by reference character 250, includes a casing element 251 formed by an upper housing 252 and a lower housing 253, as well as a pivotally mounted toggle element 254 and first and second contact elements 255 and 256, respectively. The toggle element 254 is resilient maintained in either of two positions by a detenting spring element 257.

The upper housing 252 includes a curved upper wall 258 and side walls 259 and 260. Keying means 261 functions in a manner similar to the other embodiments disclosed hereinabove. The upper wall 258 defines an elongated curved slot 262 through which a portion of the toggle element 254 projects.

The lower housing 253 includes a lower wall 264 as well as side walls 265 and 266. The lower wall 264 defines openings 267 and 268 accommodating the contact elements 255 and 256, again, as in the other embodiments.

The toggle element 254 includes a main body member 270 pivoting about an axis of rotation 271 on bearings 272 supported by corresponding bearing surfaces (not shown) formed by the upper and lower housings 252 and 253. A cam member 274 is formed integrally with the main body member 270 which also includes a recess 275 accommodating resilient detent means 257. The means 257 is formed by a single piece of resilient material bent to form a pair of looped portions 277, a pair of abutted terminals 278 positioned in a recess 279 and a medially disposed projection 280 engaging the above mentioned recess 275. Thus, by the use of only a single spring, an over center detenting action is obtained although the total rotational movement of the toggle element between positions may be as little as 30°.

Figure 14:
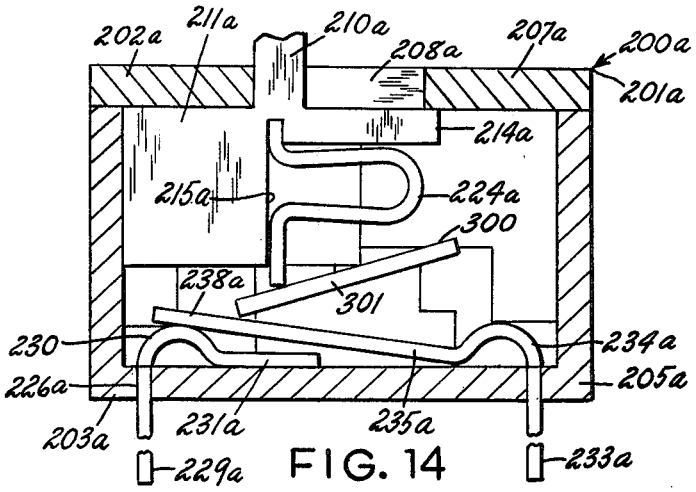
FIG. 14 is a fragmentary transverse sectional view showing a modified form of the third embodiment.
Figure 15:
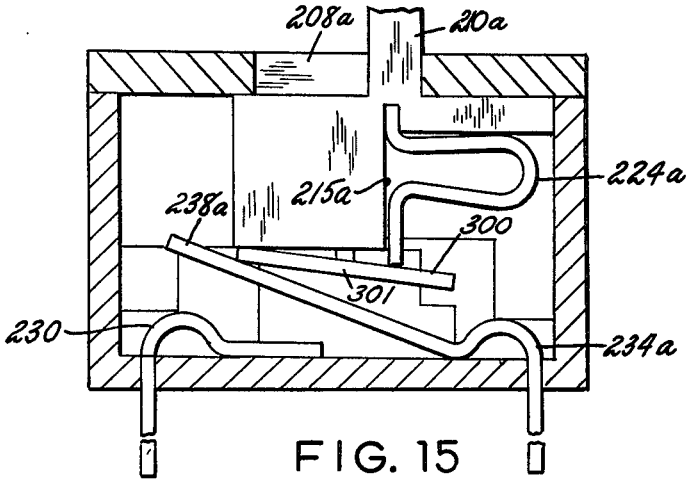
FIG. 15 is a fragmentary transverse sectional view corresponding to that seen in FIG. 14, but showing certain of the component parts in altered relative position.

Turning now to the alternate form illustrated in FIGS. 14 and 15, parts corresponding to those of the third embodiment have been designated by similar characters, with the additional suffix "a".

This forms differs from the principal form in the provision of a pivotally mounted beam 300 supported at point 301 positioned between the member 224*a* and the member 235*a*.

Figures 5, 6, 7, 8, 9:
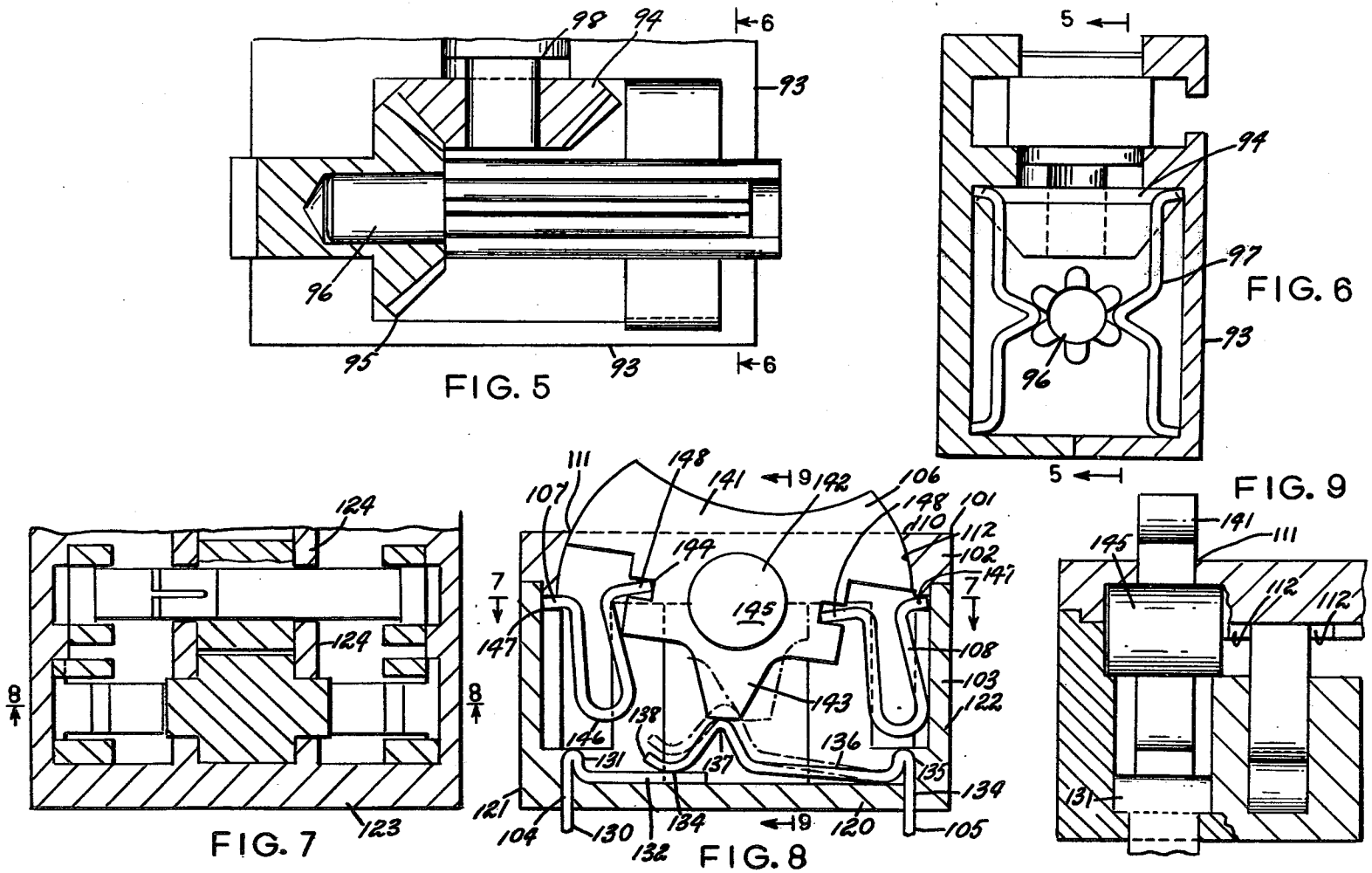
FIG. 5 is a fragmentary central horizontal sectional view of a modified form of the first embodiment as seen from the plane 5—5 in FIG. 6.
FIG. 6 is a transverse sectional view as seen from the plane 6—6 in FIG. 5.
FIG. 7 is a fragmentary longitudinal sectional view of a second embodiment of the invention as seen from the plane 7—7 in FIG. 8.
FIG. 8 is a transverse sectional view of the second embodiment as seen from the plane 8—8 in FIG. 7.
FIG. 9 is a fragmentary vertical sectional view, partly broken away of the second embodiment as seen from the plane 9—9 in FIG. 8.
Figure 16:
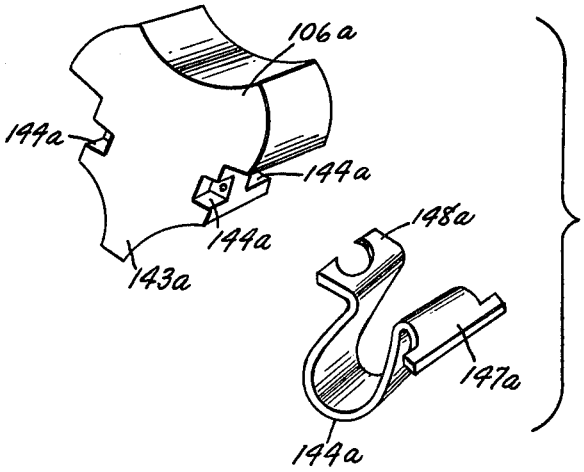
FIG. 16 is an exploded view in perspective showing a modified form of the first embodiment.

In the embodiment partially illustrated in FIG. 16, parts corresponding to those of the embodiment shown in FIG. 8 have been designated by similar reference characters with the additional suffix "a". In this embodiment, detents are provided to hold the members 148*a* in positive engagement within the recesses 144*a* to facilitate assembly.

I wish it to be understood that I do not consider the invention limited to the precise details of structure shown and set forth in this specification, for obvious modifications will occur to those skilled in the art to which the invention pertains.

I claim:

1. An improved slide-actuated switch comprising: first and second housing elements defining a hollow casing; said first housing element defining an elongated slotted opening therethrough, a sliding member having manually engageable means projecting through said slotted opening, said sliding member including a main body portion defining a recess in an inwardly facing surface; a resilient cam means positioned within said recess, said cam means including a generally wedged-shaped projection extending outwardly of said recess; said second housing element having an inwardly extending septum thereon, said septum defining a plurality of detents selectively engaging said projection; and a pair of electrically conductive contact elements disposed in overlapping relation within said casing, one of said contact elements having cam follower means thereon slidably engaging said projection on said cam means, said cam follower, when said contacts are in closed condition being positioned in the area of one of said detents.

* * * * *